US011428438B2

(12) United States Patent
Jasteh et al.

(10) Patent No.: US 11,428,438 B2
(45) Date of Patent: Aug. 30, 2022

(54) CARRYOVER BURNERS FOR FLUID HEATING SYSTEMS AND METHODS THEREOF

(71) Applicant: Rheem Manufacturing Company, Atlanta, GA (US)

(72) Inventors: Sina Jasteh, Montgomery, AL (US); Troy Trant, Montgomery, AL (US); Ashwin Rao, Montgomery, AL (US); Jason Hall, Prattville, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 16/860,607

(22) Filed: Apr. 28, 2020

(65) Prior Publication Data

US 2021/0333017 A1 Oct. 28, 2021

(51) Int. Cl.

| | |
|---|---|
| ***F23N 5/00*** | (2006.01) |
| ***F24H 9/20*** | (2022.01) |
| ***F24H 1/12*** | (2022.01) |

(52) U.S. Cl.

CPC ..... *F24H 9/2035* (2013.01); *F24H 1/124* (2013.01); *F23N 2241/04* (2020.01)

(58) Field of Classification Search

CPC ..... F23D 14/16; F23D 14/145; F23D 14/147; F23D 14/148; F23N 5/00

USPC ..... 126/92 AC, 92 C; 431/2, 328, 352, 353

See application file for complete search history.

(56) References Cited

U.S. PATENT DOCUMENTS

| | | | | | |
|---|---|---|---|---|---|
| 4,793,800 | A * | 12/1988 | Vallett | F23D 14/10 | 122/17.1 |
| 4,900,245 | A * | 2/1990 | Ahmady | C04B 35/19 | 431/328 |
| 5,197,415 | A * | 3/1993 | Stretch | F23C 3/004 | 122/14.22 |
| 5,240,411 | A * | 8/1993 | Abalos | F23D 14/145 | 431/329 |
| 5,348,468 | A * | 9/1994 | Graf | F23D 14/16 | 431/171 |
| 5,743,727 | A * | 4/1998 | Rodgers | F23D 14/105 | 239/553.3 |
| 6,159,001 | A * | 12/2000 | Kushch | F24H 1/43 | 431/7 |
| 6,572,367 | B1 * | 6/2003 | Tranquilli | F23D 14/36 | 431/353 |
| 9,739,482 | B2 * | 8/2017 | Colin | F23D 14/20 | |
| 10,801,720 | B2 * | 10/2020 | Chen | F23D 14/70 | |
| 2014/0011142 | A1 * | 1/2014 | Bertelli | F23D 14/58 | 431/326 |

(Continued)

*Primary Examiner* — Gregory A Wilson

(74) *Attorney, Agent, or Firm* — Eversheds Sutherland (US) LLP

(57) ABSTRACT

The disclosed technology includes carryover burner systems and methods for use with water heating system. The water heating system can include a burner unit having an outer sleeve, and an inner sleeve. The water heating system can also include an ignitor. The outer sleeve can include a carryover region having a first plurality of apertures and a combustion region which can be adjacent to the carryover region, the combustion region including a second plurality of apertures. The inner sleeve can comprise a dispersion region having a third plurality of apertures. The inner sleeve can be located substantially within the outer sleeve.

20 Claims, 4 Drawing Sheets

(56) References Cited

U.S. PATENT DOCUMENTS

| | | | | |
|---|---|---|---|---|
| 2015/0184850 | A1* | 7/2015 | Seeley | F23D 14/16<br>431/5 |
| 2015/0211733 | A1* | 7/2015 | Shibuya | F01N 3/025<br>431/350 |
| 2015/0330623 | A1* | 11/2015 | Beaber | F23D 14/18<br>431/328 |

* cited by examiner

CARRYOVER BURNERS FOR FLUID HEATING SYSTEMS AND METHODS THEREOF

FIELD OF THE DISCLOSURE

The present disclosure relates generally to fluid heating systems, such as water heating systems. Particularly, the present disclosure relate to carryover burner units and methods thereof.

BACKGROUND

Typically, in a down-fired water heating system, a burner unit for heating the water is located inside a heat exchanger near the top of the water tank. This configuration can cause uneven heating or, more dangerously, over-heating of the water near the top of the water tank. Further, this configuration can cause performance issues such as the water heater unnecessarily operating in short, quick cycles for even small water demands. Previous attempts to mitigate over-heating and/or uneven heating have included moving the main heat source (e.g., burner unit) farther down within the heat exchanger, but such designs require longer ignitors, which carry increased risk of electric current leaks that can result in an increased likelihood of failed ignitions, among other concerns.

Thus, it would be advantageous to mitigate over-heating and/or uneven heating of water in a water heater tank while also enabling compatibility of the burner unit with a short ignitor, which can reduce the likelihood of failed ignitions.

SUMMARY

These and other issues can be addressed by the technology disclosed herein. The disclosed technology relates generally to fluid heating systems and methods. Particularly, the disclosed technology relates to carryover burner units, fluid heating systems including a carryover burner unit, and methods thereof.

The disclosed technology includes a water heating system (e.g., a water heating burner system) comprising an outer sleeve, an inner sleeve, and an ignitor. The outer sleeve can include a carryover region (e.g., a flame carryover region) having a first plurality of apertures, and a combustion region that is adjacent to the carryover region and has a second plurality of apertures. The inner sleeve can have a dispersion region having a third plurality of apertures. The inner sleeve can be located substantially within the outer sleeve. The ignitor can be located proximate the carryover region.

The water heating system can include an end cap that can be attached to the outer sleeve proximate the combustion region. The end cap can substantially seal a first end the outer sleeve.

The water heating system can include a mesh that can be disposed circumferentially about the outer sleeve. The mesh can overlap at least a portion of the combustion region.

The inner sleeve and the outer sleeve can be concentric, and both the inner sleeve and outer sleeve can be substantially tubular.

The first plurality of apertures can comprise one or more of slots, holes, or nozzles. The second plurality of apertures can comprise one or more of slots, holes, or nozzles. The third plurality of apertures can comprise one or more of slots, holes or nozzles.

At least one of the inner sleeve or the outer sleeve can be constructed of stainless steel.

Each aperture of the third plurality of apertures can have a larger inner dimension than one or more of inner dimensions associated with the first plurality of apertures or inner dimensions associated with the second plurality of apertures.

The inner sleeve can be configured to receive fuel from a fuel source at a first opening of the inner sleeve.

The dispersion region of the inner sleeve can be configured to distribute the fuel to the carryover region and combustion region of the outer sleeve.

The carryover region and the combustion region can be configured to disperse the fuel source within a heat exchanger.

The ignitor can be configured to initiate combustion of the fuel in the carryover region.

The first plurality of apertures can be configured to transport combusting fuel between the ignitor and the combustion region.

The second plurality of apertures can be configured to receive combusting fuel from the first plurality of apertures and can maintain combustion of the fuel within the combustion region.

The disclosed technology can include a method for manufacturing a water heating system. The method can include providing an outer sleeve that includes a first plurality of apertures, and a second plurality of apertures. The method can include providing an inner sleeve including a third plurality of apertures and an opening to receive fuel. The method can further include locating the inner sleeve substantially within the outer sleeve.

The method can include attaching an end cap to an end of the outer sleeve and proximate the second plurality of apertures to substantially seal the end of the outer sleeve.

The method can include placing a mesh between the outer sleeve and the inner sleeve and proximate at least some of the second plurality of apertures of the outer sleeve.

The method can include attaching a mounting plate proximate the opening of the inner sleeve.

The disclosed technology includes a water heating system comprising a water tank and a heat exchanger having a burner unit. The burner can include an ignitor, a peripheral duct, and a central duct. The peripheral duct can include a transport zone, which can include a first plurality of apertures, and can form a pathway between the ignitor and a combustion zone. The combustion zone can be located proximate the transport zone and can include a second plurality of apertures. The central duct can be located within peripheral duct and can include a dispersion zone having a third plurality of apertures.

The central duct can be configured to receive a propellant at an opening of the central duct, and the dispersion zone of the central duct can be configured to distribute the propellant to the transport zone and combustion region of the peripheral duct. The opening can be located proximate an end of the central duct that is opposite the dispersion zone. The transport zone and the combustion zone can each be configured to disperse the propellant within the heat exchanger.

The ignitor can be configured to initiate a combustion reaction involving the propellant.

The transport zone can be configured to carry the combustion reaction between the ignitor and the combustion zone.

The combustion zone can be configured to receive the combustion reaction and maintain the combustion reaction therein.

Other implementations, features, and aspects of the disclosed technology are described in detail herein and are considered a part of the claimed disclosed technology and can be understood with reference to the following detailed description, accompanying drawings, and claims.

BRIEF DESCRIPTION OF THE FIGURES

Reference will now be made to the accompanying figures and flow diagrams, which are not necessarily drawn to scale.

DETAILED DESCRIPTION

Figure 1:
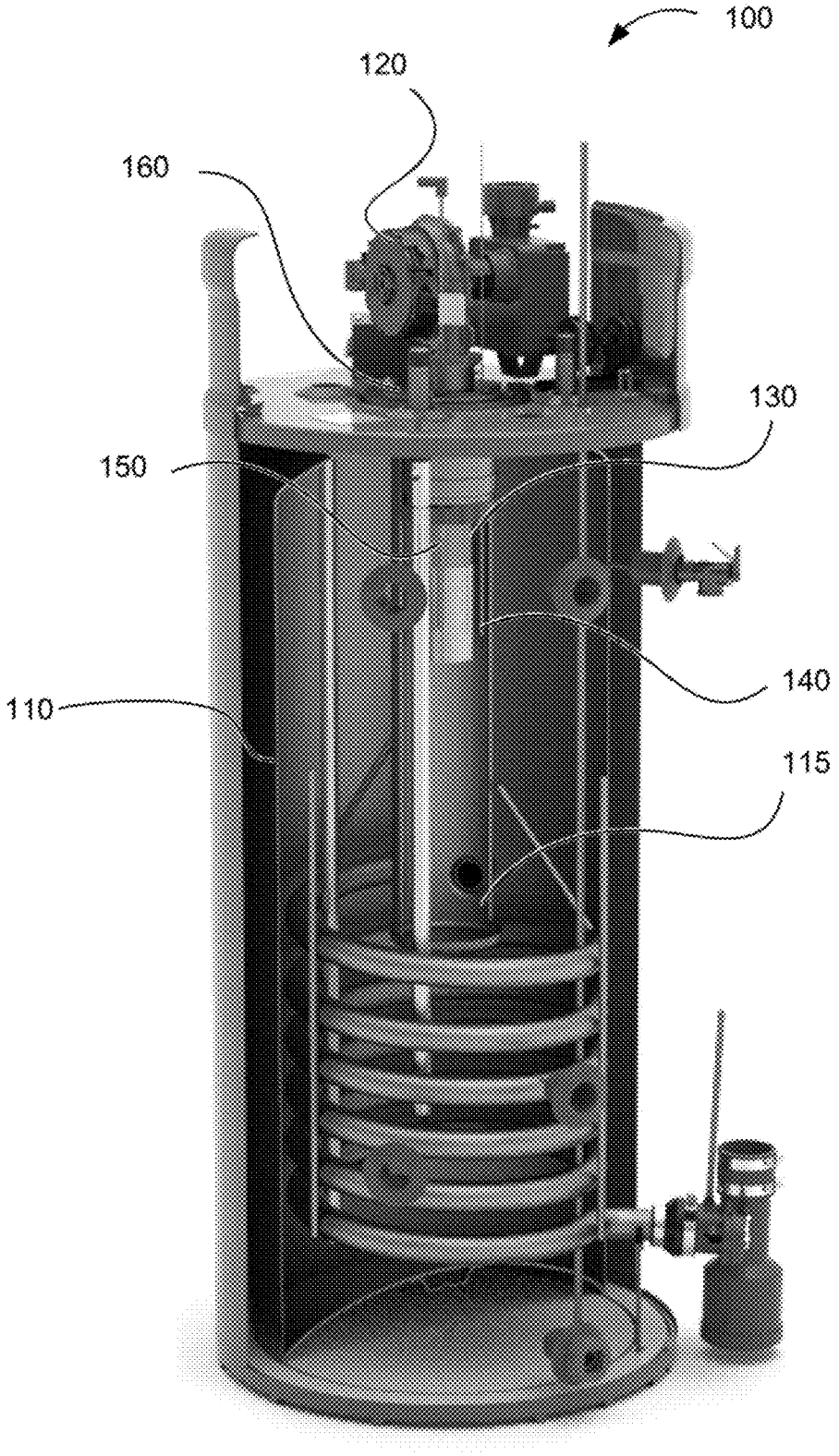
FIG. 1 is a cut-away view of an example water tank assembly, according to the disclosed technology.

Throughout this disclosure, certain examples are described in relation to down-fired burners systems and methods thereof. But the disclosed technology is not so limited. The disclosed technology can be used in other fluid heating systems (e.g., water heating systems) or other burner systems. It is to be understood that the disclosure is limited in its scope to the details of construction and arrangement of components set forth in the following description or illustrated in the drawings, and various aspects of the disclosed technology can be practiced or carried out in various ways. Also, in describing the technology, this disclosure resorts to specific terminology for the sake of clarity. It is intended that each term contemplates its broadest meaning as understood by those skilled in the art and includes all technical equivalents which operate in a similar manner to accomplish a similar purpose.

As described above, a major problem with some existing water heaters is the over-heating of the water within the water tank, which can cause uneven heating and/or, overheating of the water. Extending the length of the burner unit or main heat source to an alternate position in the heat exchanger can help mitigate the over-heating and/or uneven heating of the water, but extending the length of burner units can require longer ignitors, which can result in undesirable results, such as increased prevalence of failed ignitions, as described. What is needed, is to have a burner unit that can mitigate over-heating and/or uneven heating of the water while also compatible with an ignitor design that meets reliability requirements. These and other problems can be addressed by various aspects of the technology disclosed herein.

The present disclosure includes a water heating system that can position a main heat source (e.g., burner) at a lower position within the water heating system while also including a short ignitor. For example, the disclosed technology can include a water heating system that includes a burner unit having an outer sleeve and an inner sleeve. The water heating system can include an ignitor. The outer sleeve and the inner sleeve can both be located within a heat exchanger of the water heating system. The outer sleeve can include a carryover region having a first plurality of apertures and a combustion region having a second plurality of apertures. The combustion region can be adjacent to the carryover region. The inner sleeve can have a dispersion region that has a third plurality of apertures, and the dispersion region can be located substantially within the outer sleeve. An end cap can be attached to the outer sleeve proximate the combustion region. The end cap can be attached such that it substantially seals the outer sleeve and the inner sleeve downstream of a blower.

Some examples of the disclosed technology will be described more fully hereinafter with reference to the accompanying drawings. This disclosed technology may, however, be embodied in many different forms and should not be construed as limited to the specific examples set forth therein.

In the following description, numerous specific details are set forth. But it is to be understood that implementations of the disclosed technology may be practiced without these specific details. In other instances, well-known methods, structures, and techniques have not been shown in detail in order not to obscure an understanding of this description. References to "one implementation," "an implementation," "example implementation," "some implementations," "certain implementations," "various implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

As illustrated in FIG. 1, a fluid heater assembly 100 (e.g., a water heater assembly) can include a tank 110, a heat exchanger 115 within the tank 110, a blower 120, a carryover burner unit 130, a flame sensor 140, an ignitor 150, and/or a mounting plate 160.

The tank 110 can be glass-lined and substantially tubular. The tank 110 can be in fluid communication with the blower 120 and can include the burner unit 130 and at least a portion of the ignitor 150. Additionally or alternatively, the tank 110 can include a flame sensor 140.

The heat exchanger 115 can be substantially tubular and hollow and can be configured to receive the burner unit 130. Additionally or alternatively, the heat exchanger 115 can be configured to receive the blower 120. The heat exchanger 115 can be constructed from aluminum, copper, stainless steel, any alloys thereof, or the like.

The blower 120 can be configured to receive fuel from a fuel source and output the fuel into the burner unit 130. The blower 120 can be a centrifugal blower, positive-displacement blower, a helical screw blower, a high-speed blower, a regenerative blower, or any other type of blower that can provide fuel to the burner unit 130. The blower 120 can be configured to provide liquidous fuel, gaseous fuel, and/or air (e.g., to provide an air/fuel mixture) to the burner unit 130.

The burner unit 130, as discussed more fully below, can include an inner sleeve 240 (e.g., central duct) and an outer sleeve 231 (e.g., peripheral duct). The burner 130 can be in fluid communication with the blower 120 such that the blower 120 can output fuel and/or air toward or into the burner 130, as discussed above. The inner sleeve 240 and outer sleeve 231 can both be substantially tubular. If included, the flame sensor 140 can be located on, near, or proximate the outer sleeve 231. The flame sensor 140 can be located proximate the burner unit 130 such that the flame sensor 140 can detect whether combustion is occurring at or in the burner unit 130. The flame sensor 140 can be a UV/IR type sensor, IR/IR type, 3IR+UV type, or any other type of sensor configured to determine whether combustion is occurring.

The ignitor 150 can be located proximate the burner unit 130, such as, for example, proximate the outer sleeve 231. Alternatively, the ignitor 150 can extend into a portion of the burner unit 130. For example, the ignitor 150 can extend through a hole or slot in the outer sleeve 231 such that a portion of the ignitor is located within the wall of the outer sleeve 231. Alternatively or in addition, the ignitor 150 can be included as a component of the burner unit 130 itself. For example the ignitor can be permanently attached or affixed to the burner unit 130 (e.g., the outer sleeve 231). The ignitor 150 can be configured to initiate combustion of fuel, such as natural gas, butane, propane, or any gaseous fuel. The fuel can be introduced to the burner 130 via a fuel source such as a gas tank, a gas supply line, or the like. The ignitor 150 can be, for example, a piezo ignitor or any other type of ignitor that can generate sufficient voltage to initiate combustion.

The mounting plate 160 can be located proximate the burner unit 130, such as proximate an end of the burner unit 130. The mounting plate can be permanently attached or affixed to the burner unit 130 and/or the tank 110. Alternatively, the mounting plate 160 can be configured to detachably attach to at least a portion of the tank 110 or a component thereof. For example, the mounting plate 160 can be configured to detachably attach to the blower 120, the burner unit 130, the flame sensor 140, and/or the ignitor 150. The mounting plate can be configured to receive one or more removeable fasteners, for example, screws, bolts, or the like. Alternatively, the mounting plate can be attached via welding, soldering, an adhesive (e.g., epoxy), or any other attachment method, composition, or mechanism. The mounting plate 160 can be constructed from stainless steel or any other useful material, alloy, or combination thereof.

Figure 2:
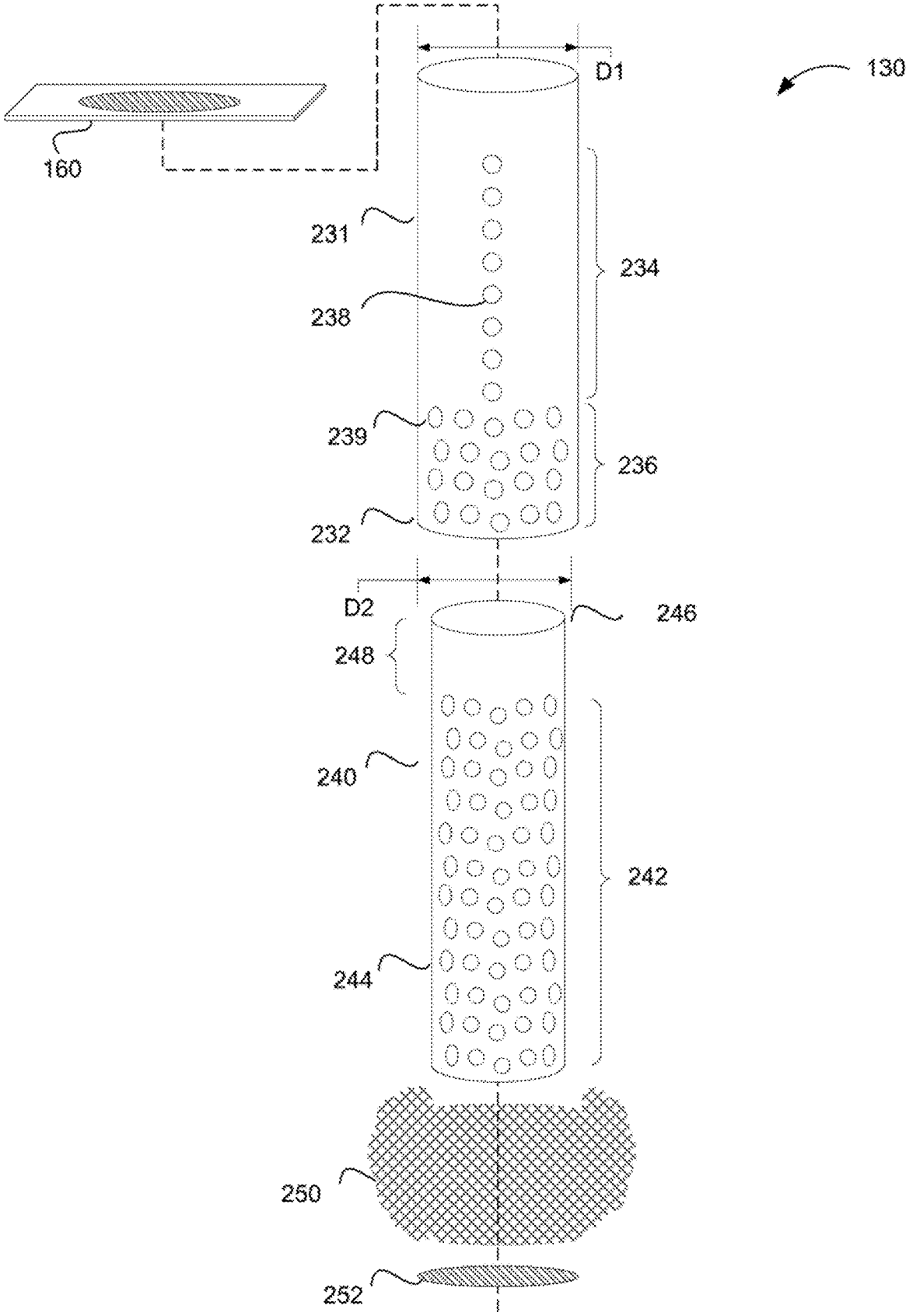
FIG. 2 is an exploded view of an example carryover burner assembly, according to the disclosed technology.

As illustrated in FIG. 2, the burner unit 130 can include the outer sleeve 231, the inner sleeve 240, a mesh 250, and/or an end cap 252. The outer sleeve 231 can have an inner diameter D1 and can include a carryover region 234 (e.g., a transport zone) that includes a first plurality of apertures 238 and a combustion region 236 (e.g., a combustion zone) that includes a second plurality of apertures 239. The first and second pluralities of apertures 238, 239 can be configured to disperse fuel (e.g., propellent) within the heat exchanger 115. The first plurality of apertures 238 (i.e., the carryover region 234) can be sized, located, and spaced such that fuel is permitted to flow through or along a pathway defined by the first plurality of apertures 238. Thus, the ignitor 150 can ignite fuel at or near one end of the pathway defined by the first plurality of apertures 238, and the first plurality of apertures 238 can be configured to transport or carryover the ignition to a second end of the pathway, which is at, near, or adjacent to the second plurality of apertures 239 (i.e., the combustion region 236). Accordingly, the carryover region 234 can be configured to transport or carryover ignition from the ignitor 150 to the combustion region 236, enabling combustion of fuel within the combustion region 236.

The pathway formed by the first plurality of apertures 238 can be substantially straight and/or axially extending along the outer sleeve 231. Alternatively, the pathway formed by the first plurality of apertures 238 can be serpentine along the outer sleeve 231. Alternatively, the pathway formed by the first plurality of apertures 238 can be helically disposed (e.g., spiraling) along the outer sleeve 231. Alternatively, the carryover region 234 can include multiple pathways formed by the first plurality of apertures 238. Alternatively, the first plurality of apertures 238 can be disposed throughout the carryover region 234 such that defined pathways are not necessarily provided. For example, the first plurality of apertures 238 can be disposed throughout some or all of the carryover region similar to the arrangement of the second plurality of apertures 239 in the combustion region 236 and/or the third plurality of apertures 244 in the dispersion region 242, as explained more fully below. This can provide carry of the ignition to the combustion region 236, as well as a region of lesser heat and/or flame (as compared to the combustion region), which can provide additional heat to the fluid. When the first plurality of apertures 238 are disposed throughout some or all of the carryover region 234, the first plurality of apertures 238 can be sized smaller (e.g., as compared to apertures 238 forming a discreet pathway).

The first plurality of apertures 238 can include one or more nozzles, one or more slots, one or more slits, one or more holes, or any combination thereof. Each of the first plurality of apertures 238 can have any useful cross-sectional shape, including but not limited to a circle, an oval, a triangle, a square, a rectangle, a pentagon, a hexagon, an octagon, any other polygon, or any other shape. All of the first plurality of apertures 238 can have the same shape. Alternatively, one or some of the first plurality of apertures 238 can have a given shape, while one or some of the remaining first plurality of apertures 238 can have one or more different shapes. Some or all of the first plurality of apertures 238 can have a maximum internal dimension (e.g., diameter) that is in the range from approximately 0.031 cm to approximately 0.062 cm, for example. As another example, some or all of the of the first plurality of apertures 238 can have a maximum internal dimension (e.g., diameter) that is in the range from approximately 1/64 inch to approximately 1/4 inch. Some or all of the first plurality of apertures 238 can have a minimum internal dimension (e.g., diameter) that is in the range from approximately 0.031 cm to approximately 0.062 cm, for example. As another example, some or all of the first plurality of apertures 238 can have a minimum internal dimension (e.g., diameter) that is in the range from approximately 1/64 inch to approximately 1/4 inch. The size of some or all of the apertures 238 can be larger or smaller, depending on the particular application.

The second plurality of apertures 239 of the combustion region 236 can be sized, located, and spaced such that fuel is permitted to flow through the second plurality of apertures 239 (e.g., into the heat exchanger 115). The second plurality of apertures 239 can be configured to receive the ignition (i.e., transfer of combustion from ignited fuel) from the first plurality of apertures 238 (i.e., the carryover region 234), which is at, near, or adjacent to the first plurality of apertures 238. Accordingly, the combustion region 236 can be configured to combust the fuel flowing through the second plurality of apertures 239 of the combustion region 236. The second plurality of apertures 239 can be formed on or through the outer sleeve 231 within the combustion region 236. Alternatively, the second plurality of apertures 239 can be formed within a portion of the combustion region 236 of the outer sleeve 231. Alternatively, the second plurality of apertures 239 can be formed in a predetermined pattern within the combustion region 236 of the outer sleeve 231. As an example, the second plurality of apertures 239 can be formed uniformly (e.g., equidistantly spaced) throughout some or all of the combustion region 236.

The second plurality of apertures 239 can include one or more nozzles, one or more slots, one or more slits, one or more holes, or any combination thereof. Each of the second plurality of apertures 239 can have any useful cross-sectional shape, including but not limited to a circle, an oval, a triangle, a square, a rectangle, a pentagon, a hexagon, an octagon, any other polygon, or any other shape. All of the second plurality of apertures 239 can have the same shape. Alternatively, one or some of the second plurality of apertures 239 can have a given shape, while one or some of the remaining second plurality of apertures 239 can have one or more different shapes. Some or all of the second plurality of apertures 239 can have a maximum internal dimension (e.g., diameter) that is in the range from approximately 0.031 cm to approximately 0.062 cm, for example. As another example, some or all of the of the second plurality of apertures 239 can have a maximum internal dimension (e.g., diameter) that is in the range from approximately 1/64 inch to approximately 1/4 inch. Some or all of the second plurality of apertures 239 can have a minimum internal dimension (e.g., diameter) that is in the range from approximately 0.031 inches to approximately 0.062 cm, for example. As another example, some or all of the of the second plurality of apertures 239 can have a minimum internal dimension (e.g., diameter) that is in the range from approximately 1/64 inch to approximately 1/4 inch. The size of some or all of the apertures 239 can be larger or smaller, depending on the particular application.

The inner sleeve 240 can have an outer diameter D2 and can include an opening 246, a dead zone 248, and/or a dispersion region 242 (e.g., dispersion zone), which includes a third plurality of apertures 244. The outer diameter D2 of the inner sleeve 240 can be less than the inner diameter D1 of the outer sleeve 231 such that the inner sleeve 240 can be inserted or at least partially inserted into the outer sleeve 231. The inner sleeve 240 and outer sleeve 231 can be axially aligned such that the inner sleeve 240 is concentric with respect to the outer sleeve 231. The inner sleeve 240 and/or outer sleeve 231 can be constructed from stainless steel or any other useful material, alloy, or combination thereof.

The opening 246 of the inner sleeve 240 can be configured to receive fuel from the blower 120. Additionally, the opening 246 can be configured to receive at least a portion of the blower 120. That is, at least a portion of the blower 120 can extend into the inner sleeve 240. The dead zone 248 can refer to a portion of the inner sleeve through which fuel passes but in which combustion of the fuel does not occur, and the dead zone 248 can be located at, near, or adjacent to the opening 246. The dead zone 248 can be configured and/or dimensioned to stabilize variations in fuel flow and/or the concentration of fuel exiting the blower 120 and can permit passage of the fuel to the dispersion region 242. Stabilizing the fuel flow can be advantageous to reduce the likelihood of unpredictable or uncontrolled combustion as a result of unsteady flow from the blower 120. The force and/or velocity of the fuel within the dead zone 248 (e.g., as provided by the blower 120) can prevent the fuel from combusting within the dead zone 248. Additionally or alternatively, the dead zone 248 can be configured and/or dimensioned to locate the combustion region 236 within the heat exchanger 115 such that the combustion of fuel occurs in a portion of the heat exchanger 115 particularly suited to withstand temperatures and/or pressures associated with the combustion of fuel. Additionally or alternatively, the dead zone 248 can be configured and/or dimensioned to locate the carryover region 234 and/or the combustion region 236 a distance from the mounting plate 160 and/or the blower 120 such that temperatures and/or pressures associated with the combustion of fuel do not adversely affect the mounting plate 160 and/or the blower 120.

The dispersion region 242 can be configured to receive fuel from the dead zone 248 and disperse it to the combustion region 236 and/or carryover region 234. The dispersion region 242 can be configured to disperse the fuel via a third plurality of apertures 244. The third plurality of apertures 244 can be sized, located, and spaced such that fuel is permitted to flow through the third plurality of apertures 244 and into the first and/or second plurality of apertures 238, 239. The third plurality of apertures 244 can be configured to uniformly disperse the fuel to an intermediate zone between the inner and outer sleeves 231, 240. The third plurality of apertures 244 can be configured to uniformly disperse the fuel to the first and/or second plurality of apertures 238, 239 for combustion. Alternatively, the dispersion region 242 can be configured to selectively disperse the fuel passing through the third plurality of apertures 244 to the intermediate zone, the first plurality of apertures 238, and/or the second plurality of apertures 239 for combustion.

The third plurality of apertures 244 can be formed uniformly (e.g., equidistantly spaced) throughout some or all of the dispersion region 242. Alternatively, the third plurality of apertures 244 can be formed within only a portion of the dispersion region 242. Alternatively, the third plurality of apertures 244 can be formed in a predetermined pattern within some or all of the dispersion region 242. The third plurality of apertures 244 can include one or more nozzles, one or more slots, one or more slits, one or more holes, or any combination thereof. Each of the third plurality of apertures 244 can have any useful cross-sectional shape, including but not limited to a circle, an oval, a triangle, a square, a rectangle, a pentagon, a hexagon, an octagon, any other polygon, or any other shape. All of the third plurality of apertures 244 can have the same shape. Alternatively, one or some of the third plurality of apertures 244 can have a given shape, while one or some of the remaining third plurality of apertures 244 can have one or more different shapes. Some or all of the third plurality of apertures 244 can have a maximum internal dimension (e.g., diameter) that is in the range from approximately 0.031 inches to approximately 0.062 cm, for example. As another example, some or all of the of the third plurality of apertures 244 can have a maximum internal dimension (e.g., diameter) that is in the range from approximately 1/64 inch to approximately 1/4 inch. Some or all of the third plurality of apertures 244 can have a minimum internal dimension (e.g., diameter) that is in the range approximately 0.031 inches to approximately 0.062 cm, for example. As another example, some or all of the of the third plurality of apertures 244 can have a minimum internal dimension (e.g., diameter) that is in the range from approximately 1/64 inch to approximately 1/4 inch. The size of some or all of the apertures 244 can be larger or smaller, depending on the particular application.

Optionally, a mesh 250 can envelope the outer sleeve 231 circumferentially and proximate the combustion region 236 and can help reduce NOx emission from the burner unit 130. For example, the mesh 250 can help satisfy low NOx or ultra-low NOx emission limits (or related industry standards). The mesh 250 can help make the flame radiant.

Additionally or alternatively, the mesh 250 can be disposed between the inner sleeve 240 and the outer sleeve 231. The mesh 250 can be disposed near, or adjacent to the dispersion region 242. The mesh 250 can envelop the dispersion region 242 circumferentially. Alternatively, the mesh 250 can be disposed near, or adjacent, or between the outer sleeve 231 and inner sleeve 240, overlapping a portion of the dispersion region 242. The mesh 250 can be configured to allow fuel to pass therethrough. Additionally or alternatively, the mesh 250 can be wrapped around the inner sleeve 240. The mesh 250 can be constructed from or include stainless steel, Inconel, any useful combination thereof, or the like.

The end cap 252 can be attach to the outer sleeve 231 proximate the combustion region 236. For example, the end cap 252 can be located at the end of the outer sleeve 231 (and/or inner sleeve 240) that is opposite the mounting plate 160. The end cap 252 can substantially seal the outer sleeve 231 and/or the inner sleeve 240 downstream of the blower 120. As non-limiting examples, the end cap 252 can be attached to the outer sleeve 231 using welds, adhesive, fasteners, gaskets, or the like.

Figure 3:
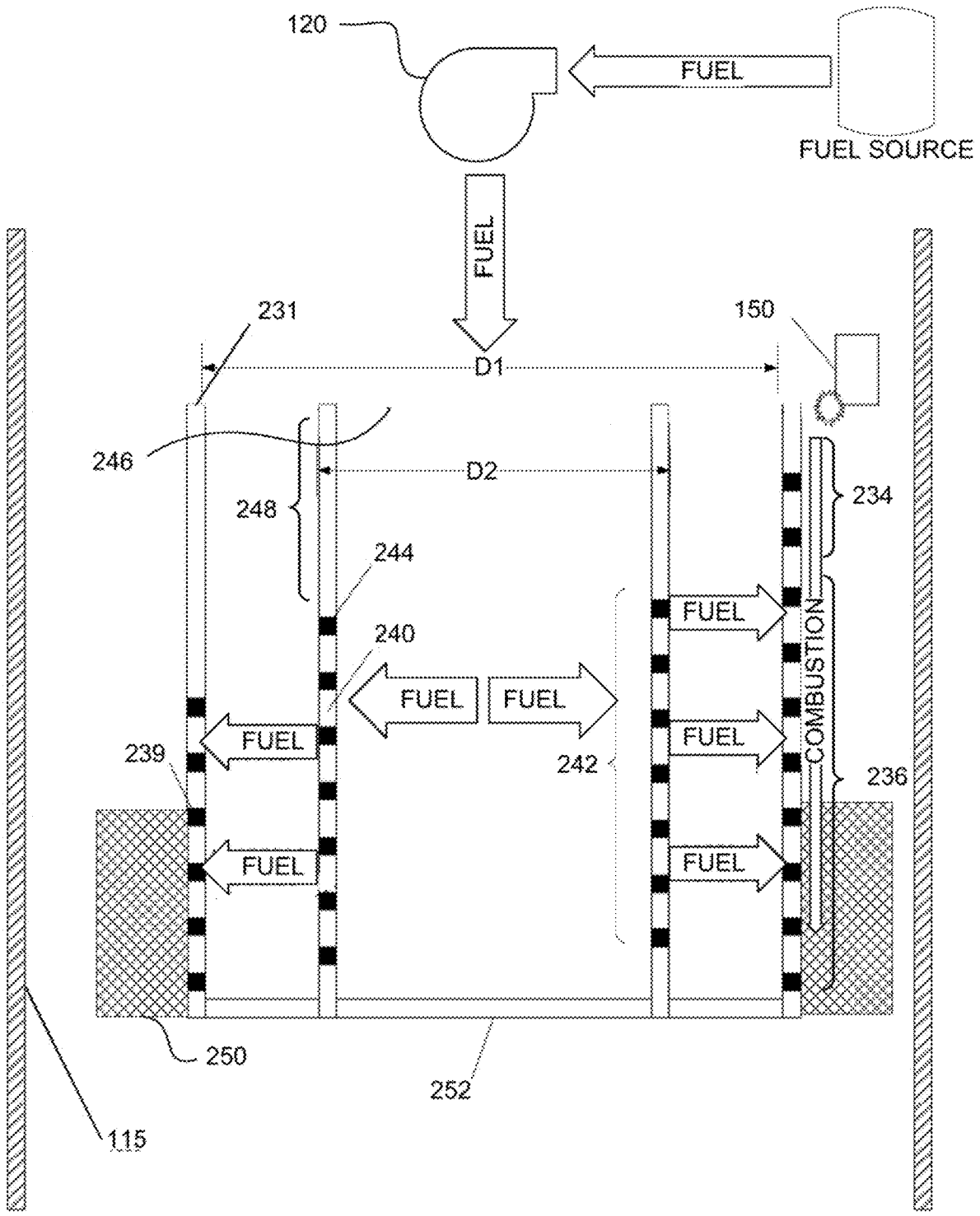
FIG. 3 is a section view of an illustrative schematic for an example carryover burner assembly, according to the disclosed technology.

As illustrated in FIG. 3, a blower 120 can introduce fuel into the inner sleeve 240 though the opening 246. The dead zone 248 of the inner sleeve 240, which can be configured to stabilize fuel flow, can receive the fuel from the blower 120. The dispersion region 242 can receive the fuel from the dead zone 248, where the fuel can then pass through multiple apertures (i.e., the third plurality of apertures 244 in a dispersion region), which can be configured to disperse fuel to a volume of space between the inner sleeve 240 and the outer sleeve 231 to reach multiple apertures in the outer sleeve 231 (i.e., the first plurality of apertures 238 of the carryover region and the second plurality of apertures 239 of the combustion region). Optionally, a mesh 250 can be disposed circumferentially around the second plurality of apertures 239 of the outer sleeve 231, and the fuel can pass though the mesh 250 upon exiting the second plurality of apertures 239. Additionally or alternatively, the mesh 250 can be disposed in a volume of space between the inner sleeve 240 and the outer sleeve 231, and the fuel can pass through the mesh 250 upon exiting the third plurality of apertures 244. The carryover region 234 can receive the fuel via the mesh 250 and/or the third plurality of apertures 244 of the dispersion region 242, and/or the second plurality of apertures 239 of the combustion region 236. The carryover region 234 can the fuel to pass through the first plurality of apertures 238 to traverse a pathway leading to the ignitor 150. Additionally, some of the fuel can disperse through the first plurality of apertures 238 and/or the second plurality of apertures 239 and into or within the heat exchanger 115. The ignitor 150 can initiate ignition or combustion of the fuel within the heat exchanger 115. The carryover region 234 can transport the ignition (e.g., the igniting flame) from the ignitor 150 to the combustion region 236 via the first plurality of apertures 238. The second plurality of apertures 239 of the combustion region 236 can receive the ignition from the ignitor 150 transferred or carried over from the ignitor 150 and by the carryover region 234 and can ignite the fuel received via the mesh 250 and/or the third plurality of apertures 244. The combustion region 236 can thus maintain the ignition and/or combustion reaction using fuel received via the third plurality of apertures 244 and/or the mesh 250.

Figure 4:
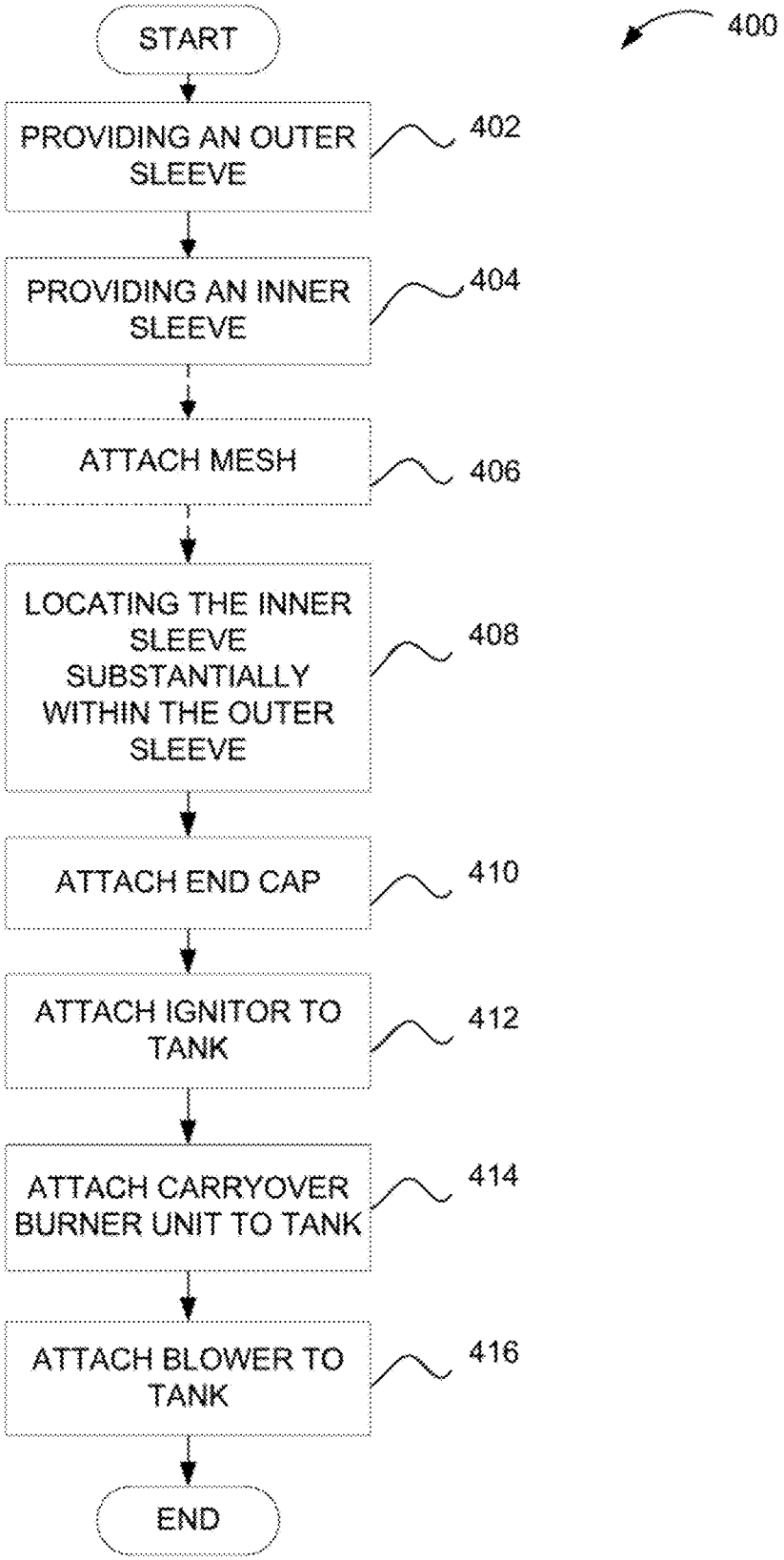
FIG. 4 illustrates a method for manufacturing an example carryover burner assembly, according to the disclosed technology.

FIG. 4 illustrates an example method 400 for manufacturing an example carryover burner unit. The method 400 can include providing 402 an outer sleeve 231. The outer sleeve 231 can be rolled, ironed, deep drawn, or the like. The first plurality of apertures 238 can be perforated, stamped, drilled, cut, pierced, blanked, punched, or the like. Likewise, the second plurality of apertures 239 can be perforated, stamped, drilled, cut, pierced, blanked, punched, or the like.

The method 400 can include providing 404 an inner sleeve 240. The inner sleeve 240 can be rolled, ironed, deep drawn, or the like. The third plurality of apertures 244 can be perforated, stamped, drilled, cut, pierced, blanked, punched, or the like.

The method 400 can include attaching 406 the mesh 250 to the outer sleeve 231. The mesh 250 can be detachably attached to the outer sleeve 231 using, for example, adjustable fasteners (e.g., hose clamps). Alternatively, the mesh 250 can be permanently attached to the outer sleeve 231. Alternatively, the mesh can be attached to the inner sleeve 240. The mesh 250 can be detachably attached to the outer sleeve 231 using, for example, adjustable fasteners (e.g., hose clamps). Alternatively, the mesh 250 can be simply inserted between the inner sleeve and the outer sleeve. Alternatively, the mesh 250 can be permanently attached to the inner sleeve 240.

The method 400 can include positioning 408 the inner sleeve 240 substantially within the outer sleeve 231. The inner sleeve 240 can be positioned using a jig, a manipulator, an industrial robot, a rotary index table, or the like. The inner sleeve 240 can be positioned such that the inner sleeve and outer sleeve are axially aligned and/or concentric.

The method 400 can include attaching 410 the end cap 252 to the outer sleeve 231 and/or inner sleeve 240. The end cap 252 can be welded, glued, brazed, soldered, or the like. The end cap 252 can be attached near or adjacent to the combustion region 236.

The method 400 can include attaching 412 the ignitor 150 to the tank 110 and/or burner 130 proximate an end opposite the end cap 252. As an example, the ignitor 150 can be detachably attached using removeable fasteners, for example, screws, clips, bolts or the like.

The method 400 can include attaching 414 the inner sleeve 240, outer sleeve 231 and end cap 252 assembly to the tank 110 using removeable fasteners proximate the ignitor 150. Additionally or alternatively, the inner sleeve 240, outer sleeve 231 and end cap 252 assembly can be attached to the tank 110 via a mounting plate 160 The inner sleeve 240, outer sleeve 231 and end cap 252 assembly can be detachably or permanently attached to the tank 110.

The method 400 can include attaching 416 the blower 120 to the tank 110. The blower 120 can be detachably attached to the tank 110 using, for example, removable fasteners. Alternatively, the blower 120 can be permanently attached to the tank 110. The blower 120 can be attached to the tank 110 proximate the opening 246 of the inner sleeve 240. Additionally or alternatively, the blower 120 can be attached to the mounting plate 160. The blower can be detachably attached to the mounting plate 160 using removeable fasteners or can be permanently attached to the mounting plate 160 (e.g., via welding). The mounting plate 160 can be detachably attached to the tank 110 using removeable fasteners or can be permanently attached to the tank 110 (e.g., via welding).

It is to be understood that the processes and methods described above can be combined and/or modified without limitation. Any step described with respect to one figure, process, or method can be combined with another figure, process, or method. Additionally, any of the disclosed methods or processes can be understood to omit some of the steps expressly described and/or can include additional steps not expressly shown or discussed herein.

While certain techniques and methods of the disclosed technology have been described in connection with what is presently considered to be the most practical implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

Further, while one or more examples may be discussed as having certain advantageous features, one or more of such features may also be used with the various other examples of the disclosure discussed herein. In similar fashion, while examples may be discussed herein as devices, systems, or methods, it is to be understood that such examples can be implemented in various devices, systems, and methods of the present disclosure.

This written description uses examples to disclose certain implementations of the disclosed technology, including the best mode, and also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A water heating system comprising:

an outer sleeve comprising:

a carryover region having a first plurality of apertures configured to permit a fuel to pass therethrough at a first flow; and a combustion region adjacent the carryover region, the combustion region including a second plurality of apertures configured to permit the fuel to pass therethrough at a second flow, the second flow being greater than the first flow;

an inner sleeve located substantially within the outer sleeve, the inner sleeve including a dispersion region having a third plurality of apertures configured to permit the fuel to pass therethrough; and an ignitor located proximate the carryover region and configured to ignite the fuel at the carryover region to create a flame to heat water of the water heating system, wherein the first plurality of apertures form an ignition pathway from the ignitor to the combustion region, the ignition pathway extending at least partially in a longitudinal direction along the outer sleeve.

2. The water heating system of claim 1 further comprising:

an end cap attached to the outer sleeve proximate the combustion region, the end cap configured to substantially seal a first end of the outer sleeve.

3. The water heating system of claim 1 further comprising:

a mesh disposed circumferentially about the outer sleeve, the mesh overlapping at least a portion of the combustion region.

4. The water heating system of claim 1, wherein the inner sleeve and the outer sleeve are concentric and each of the inner sleeve and outer sleeve is substantially tubular.

5. The water heating system of claim 1, wherein:

the first plurality of apertures comprise one or more of: slots, holes, or nozzles;

the second plurality of apertures comprise one or more of: slots, holes, or nozzles; and the third plurality of apertures comprise one or more of: slots, holes, or nozzles.

6. The water heating system of claim 1, wherein each aperture of the third plurality of apertures has a larger inner dimension than one or more of: inner dimensions associated with the first plurality of apertures or inner dimensions associated with the second plurality of apertures.

7. The water heating system of claim 1, wherein the inner sleeve is configured to receive fuel from a fuel source at an opening of the inner sleeve.

8. The water heating system of claim 7, wherein the dispersion region of the inner sleeve is configured to distribute the fuel to the carryover region and combustion region of the outer sleeve.

9. The water heating system of claim 7, wherein each of the carryover region and the combustion region are configured to disperse the fuel source within a heat exchanger.

10. The water heating system of claim 1, wherein the first plurality of apertures is configured to transport combusting fuel between the ignitor and the combustion region.

11. The water heating system of claim 1, wherein the second plurality of apertures is configured to receive combusting fuel from the first plurality of apertures and maintain combustion of the fuel within the combustion region.

12. The water heating system of claim 1, wherein the second plurality of apertures comprises one or more apertures that are larger than one or more apertures of the first plurality of apertures.

13. The water heating system of claim 1, wherein the third plurality of apertures are configured to permit the fuel to pass therethrough to an intermediate zone between the outer sleeve and the inner sleeve.

14. A method for manufacturing a burner unit, the method comprising:

providing an outer sleeve comprising:

a first plurality of apertures forming a carryover pathway and configured to permit a fuel to pass therethrough at a first flow;

a second plurality of apertures forming a combustion region and configured to permit the fuel to pass therethrough at a second flow, the second flow being greater than the first flow;

providing an inner sleeve comprising a third plurality of apertures forming a dispersion region and an opening to receive fuel; and locating the inner sleeve substantially within the outer sleeve, wherein the carryover pathway extends at least partially in a longitudinal direction along the outer sleeve, the carryover pathway extending between an ignition location on the outer sleeve and the combustion region.

15. The method of claim 14, the method further comprising:

attaching an end cap to an end of the outer sleeve and proximate the second plurality of apertures to substantially seal the end of the outer sleeve.

16. The method of claim 14, the method further comprising:

placing a mesh between the outer sleeve and the inner sleeve and proximate the second plurality of apertures of the outer sleeve.

17. A water heating system comprising:

a water tank; and a heat exchanger comprising a burner unit that includes:

a peripheral duct comprising:

a transport zone having a first plurality of apertures forming a pathway between an ignition location at a first end of the transport zone and a combustion zone at a second end of the transport zone, the first plurality of apertures configured to permit a fuel to pass therethrough at a first flow; and the combustion zone located proximate the transport zone and including a second plurality of apertures, the second plurality of apertures configured to permit the fuel to pass therethrough at a second flow, the second flow being greater than the first flow;

a central duct located within the peripheral duct, the central duct including a dispersion zone having a third plurality of apertures configured to permit the fuel to pass therethrough; and an ignitor located proximate the ignition location of the transport zone and configured to ignite the fuel at the ignition location to create a flame to heat water of the water heating system.

18. The water heating system of claim 17, wherein:

the central duct is configured to receive the fuel at an opening of the central duct, the opening being located proximate an end of the central duct that is opposite the dispersion zone, the dispersion zone of the central duct is configured to distribute the fuel to the transport zone and combustion region of the peripheral duct, and the transport zone and the combustion zone are configured to disperse the fuel within the heat exchanger.

19. The water heating system of claim 18, wherein:

the ignitor is configured to initiate a combustion reaction involving the fuel, the transport zone is configured to carry the combustion reaction between the ignitor and the combustion zone, and the combustion zone is configured to receive the combustion reaction and maintain the combustion reaction therein.

20. The water heating system of claim 17, wherein:

the heat exchanger extends into the water tank from a first end of the water tank;

the ignitor and a first end of the transport zone are located proximate a first end of the heat exchanger; and the combustion zone is located proximate a second end of the transport zone a first distance from the first end of the water tank.

* * * * *